US006619660B2

(12) United States Patent
Schaefer et al.

(10) Patent No.: US 6,619,660 B2
(45) Date of Patent: Sep. 16, 2003

(54) LOTTERY TICKET PLAY ACTION GAME

(75) Inventors: Carla Schaefer, San Antonio, TX (US); Etienne Couelle, Outremont (CA)

(73) Assignee: Oberthur Gaming Technologies, Inc, Montreal (CA)

( * ) Notice: Subject to any disclaimer, the term of this patent is extended or adjusted under 35 U.S.C. 154(b) by 0 days.

(21) Appl. No.: 09/920,265

(22) Filed: Aug. 1, 2001

(65) Prior Publication Data

US 2003/0025270 A1 Feb. 6, 2003

Related U.S. Application Data

(60) Provisional application No. 60/225,836, filed on Aug. 16, 2000.

(51) Int. Cl.[7] ..... A63F 3/06
(52) U.S. Cl. ..... 273/139; 283/903
(58) Field of Search ..... 273/138.1, 139, 273/274; 283/903

(56) References Cited

U.S. PATENT DOCUMENTS

| | | | | |
|---|---|---|---|---|
| 4,491,319 | A | | 1/1985 | Nelson |
| 5,411,260 | A | | 5/1995 | Smith |
| 5,580,054 | A | * | 12/1996 | Shneifer |
| 5,938,200 | A | * | 8/1999 | Markowicz et al. |
| 5,996,997 | A | | 12/1999 | Kamille |

FOREIGN PATENT DOCUMENTS

| | | |
|---|---|---|
| FR | 2656713 | 7/1991 |

* cited by examiner

*Primary Examiner*—William M. Pierce
(74) *Attorney, Agent, or Firm*—Watov & Kipnes, P.C.

(57) ABSTRACT

A lottery ticket having a first play area including individual play regions each of which contains a player-identification symbol, a prize defeating symbol or a neutral and a second play area which is associated with the first play area and which at least in part determines whether a prize has been won.

12 Claims, 4 Drawing Sheets

LOTTERY TICKET PLAY ACTION GAME

This application claims the benefit of provisional application 60/225,836 filed Aug. 16, 2000.

FIELD OF THE INVENTION

The present invention is directed to a lottery ticket in which the play action game is based on chance or is controlled by the player. The play action game provides for movement of the player through a first play area in which each play region within the first play area may be provided with a prize supporting symbol, a prize defeating symbol or a neutral symbol which may be a player-identification symbol. The player may win a prize if he or she uncovers a prize supporting symbol and/or accumulates a minimum of prize supporting symbols within the first play area or an optional second play area before obtaining a preselected number of prize defeating symbols.

BACKGROUND OF THE INVENTION

Scratch-off lottery tickets are common in the lottery industry. Game data is covered by a scratch-off layer and when the scratch-off layer is removed, the game data is exposed. Once the scratch-off layer is removed, if the game symbols provide a certain pattern (e.g. three of the same symbol) the player may win a prize. Thus, the typical scratch-off lottery tickets require the player to remove the scratch-off layer and immediately determine what prize has been won.

It is desirable in the scratch-off lottery industry to provide lottery tickets which not only provide the opportunity to win a prize, but also provide the opportunity to play a game which adds to the volume and entertainment of the lottery ticket itself. One class of such games are games based on chance in which the outcome of the game and whether a prize is won is solely determined by the lottery ticket itself. Another class of games are called probability games in which the player has some control over the actions taken to seek a prize. Both classes of games provide excitement and stimulation because they provide the added element of playing a game in addition to the opportunity to win a prize.

It would therefore be a significant advance in the scratch-off lottery ticket industry to provide a lottery game which can be based on chance or probability and which provides the player the opportunity to play a game and possibility of winning a valuable prize.

SUMMARY OF THE INVENTION

The present invention is generally directed to a lottery ticket having a first play area in the form of a plurality of individual play regions each covered by a scratch-off layer. The individual play regions contain a prize supporting symbol, a prize defeating symbol or a neutral symbol which may be a player-identification symbol. A second play area provides instructions to the player as to which individual play regions may be uncovered to reveal one of the above-mentioned symbols contained therein or to identify a prize that a player may win. The player proceeds from a starting point, optionally in accordance with the instructions obtained from the second play area, and continues the game until the relevant game playing indicia have been exposed. The play action game may be play as a game of chance or a probability game.

In one particular aspect of the present invention, there is provided a lottery ticket having a play action game with a first play area comprising a plurality of individual play regions, each of which contains a prize supporting symbol, a prize defeating symbol or a neutral symbol wherein all of the individual play regions are covered by a scratch-off layer. A second play area contains a plurality of directional symbols, each of which directs the player as to which individual play regions may be uncovered to play the game. A prize may be won if the player accumulates at least a minimum number of prize supporting symbols. In one aspect of the play action game, the minimum number of prize supporting symbols must be uncovered before accumulating a preselected number of prize defeating symbols.

In this embodiment of the invention, the game may be based on chance by having the lottery ticket itself require the player to play only preselected directional symbols. In particular, the lottery ticket is provided with a preselected number of spaces in the second play area each of which contains a directional symbol. The player is required to play the game in accordance with the instructions obtained from each of the directional symbols. The outcome of the game is therefore predetermined by the lottery ticket itself.

The game may be played as a probability game wherein the player selects his or her own directional symbols from the second play area. Thus, the second game area is provided with a preselected number of spaces each containing a directional symbol and the player is required to select a number of spaces which are less than the total number of spaces available in the second play area. Thus, the course of the play action game and the outcome of the game is determined by the player.

In a further embodiment of the invention the play action is based on chance. Each individual play region contains either a player-identification symbol or another symbol which may include a prize defeating symbol. The player uncovers all of the individual play regions and if a player-identification symbol appears in an individual play region corresponding to prize containing information in a corresponding second play area, a prize may be won.

BRIEF DESCRIPTION OF THE DRAWINGS

The following drawings in which like reference characters indicate like parts are illustrative of embodiments of the invention and are not intended to limit the invention as disclosed in the application.

DETAILED DESCRIPTION OF THE INVENTION

Figure 1:
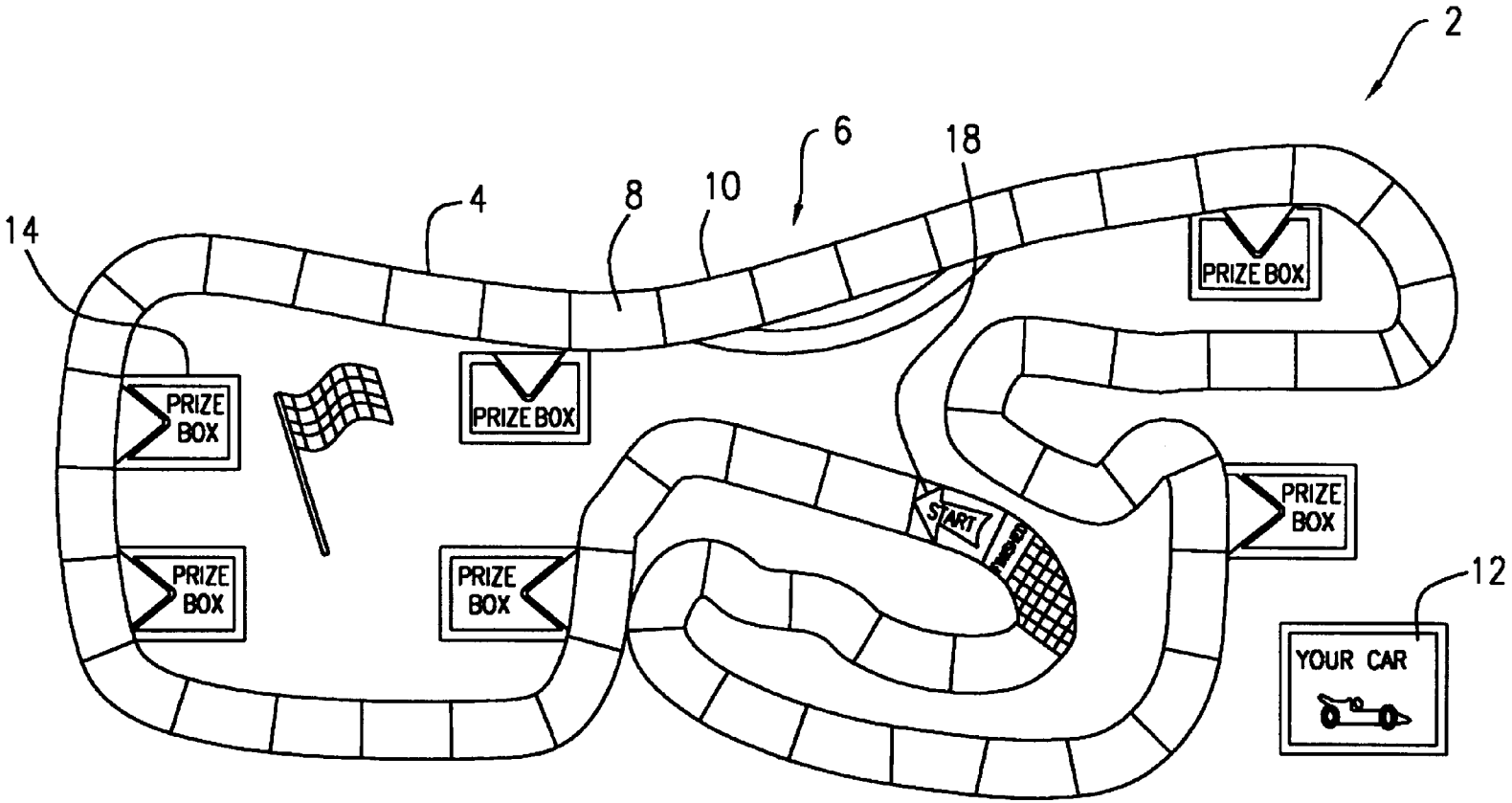
FIG. 1 is the top view of a first embodiment of a lottery ticket of present invention in which the play action is a game of chance.
Figure 2:
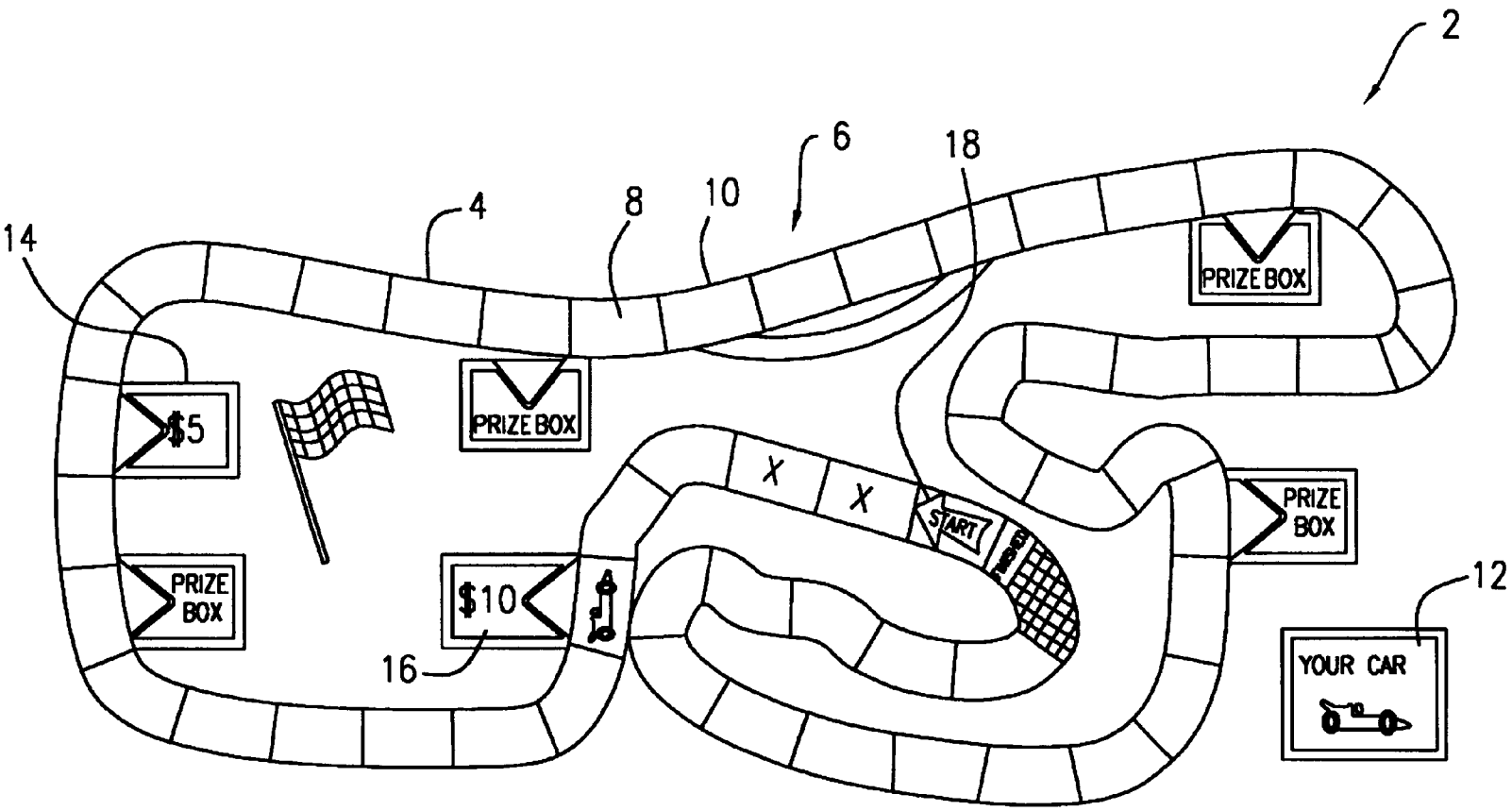
FIG. 2 is a top view of the lottery ticket of FIG. 1 showing the removal of the scratch-off layer covering some of the individual play regions within the play area.

Referring to FIGS. 1 and 2 there is shown a lottery ticket as an embodiment of the present invention. The lottery ticket 2 has a top face 4 which includes a play area 6 comprised of individual play regions 8 each of which is covered by a scratch-off layer 10. The play area 6 may be in any form but must include a minimum of two individual play regions, most preferably five or six or more play regions. The arrangement of the play regions can be in a variety of different formats so long as their location can be readily identified by the player in accordance with the instructions of playing the game as described in detail hereinafter. As shown specifically in FIGS. 1 and 2, the individual play regions 8 are in a continuous line in the form of a race car track.

In the embodiment shown specifically in FIG. 1, each of the individual play regions 8 will contain a player-identification symbol such as a particular race car and/or particular race car color. The player will identify his or her particular player-identification symbol by removing the scratch-off layer from a player-identification area 12. Beneath the scratch-off layer covering the player-identification area 12 is a particular race car and/or particular race car color which shall signify the race car and/or color to be played by the holder of the lottery ticket. It will be understood that other player-identification symbols may be employed in accordance with the theme of the play action game.

Each of the individual play regions 8 will contain either the player-identification symbol contained within the area 12 or another symbol. The other symbol may be a different race car or different race car color or combination thereof or any other symbol which is not identified in the area 12 including a prize defeating symbol (e.g. a car crash). Associated with at least one individual play region 8 is a second play area 14 which contains a prize supporting symbol 16 (see FIG. 2). As specifically shown in FIGS. 1 and 2, there are a plurality of such second play areas 14 associated with individual play regions 8 of the first play area 6. Each of the second play areas 14 have a prize supporting symbol 16 typically, but not necessarily, beneath a scratch-off layer (compare FIGS. 1 and 2).

The play action game depicted in FIGS. 1 and 2 is a game of chance and is played in the following manner. The player first removes the scratch-off layer from the player-identification area 12 to determine the players, player-identification symbol such as a particular race car, color combination thereof or the like. Beginning at the starting line 18, the player then removes the scratch-off layer from each of the individual play regions 8 until he or she comes to an associated second play area 14 which reveals a prize. If the player-identification symbol which appears in the player-identification area 12 appears in the individual play region 8 associated with the second play area 14, then a prize may be won. In a preferred form of the embodiment of FIGS. 1 and 2, each of the individual play regions 8 contains the player-identification symbol or another symbol which may be a prize defeating symbol so that by uncovering the symbols contained in consecutive individual play regions 8, the lottery ticket simulates a race to get to each of the second play areas 14. If a prize defeating symbol is uncovered in one or more individual play regions 8, this may result in a losing ticket.

The embodiment of FIGS. 1 and 2 is a game of chance because the symbols contained within the individual play regions 8 which are associated with the second play area 14 are predetermined and thus the outcome of the game is determined by the lottery ticket itself.

As shown in FIG. 2, the player begins at the starting line 18 and uncovers the first individual play region 8 by removing the scratch-off layer 10. As shown specifically in FIG. 2, the first individual play region 8 contains a non-player symbol (shown as an "X" for the sake of illustration). The player continues to remove the scratch-off layer from consecutive individual play regions until reaching a second play area 14 containing a prize (e.g. $10). It will be noted that the individual play region 8 associated with the particular second play area 14 contains the player-identification symbol. Under these circumstances, the player wins the prize contained within the second play area 14. The game is continued with the player winning a prize each time the player-identification symbol appears in the individual play region 8 associated with the second play area 14. If another symbol appears in the individual play region then the prize contained within the second play area 14 is not available to the player. In one alternative aspect of the embodiment of FIGS. 1 and 2, one or more individual play regions may contain a prize defeating symbol (e.g. a car crash) which may result in a losing ticket.

Figure 3:
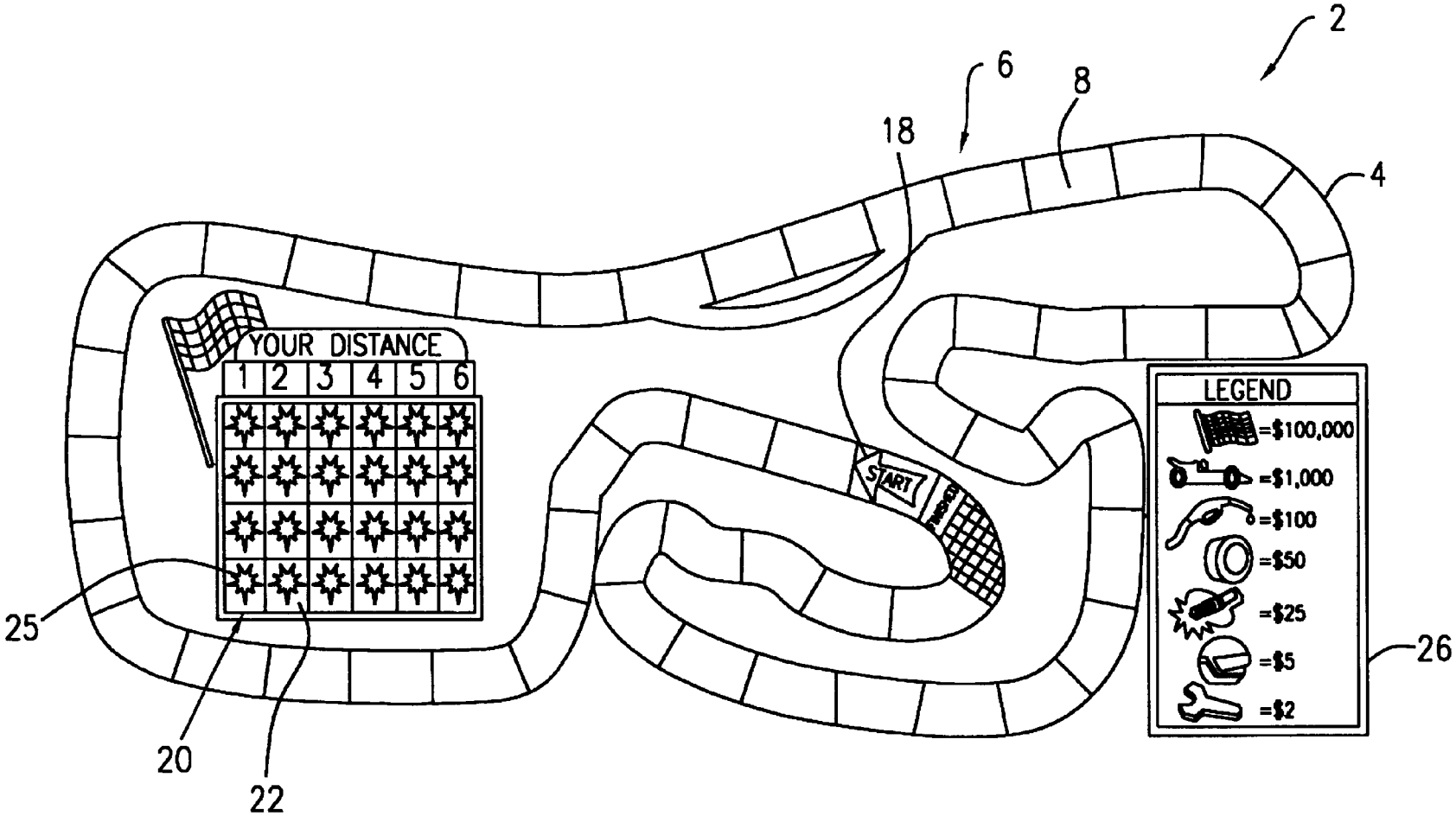
FIG. 3 is a top view of another embodiment of the present invention in which the play action provides for a probability game.
Figure 4:
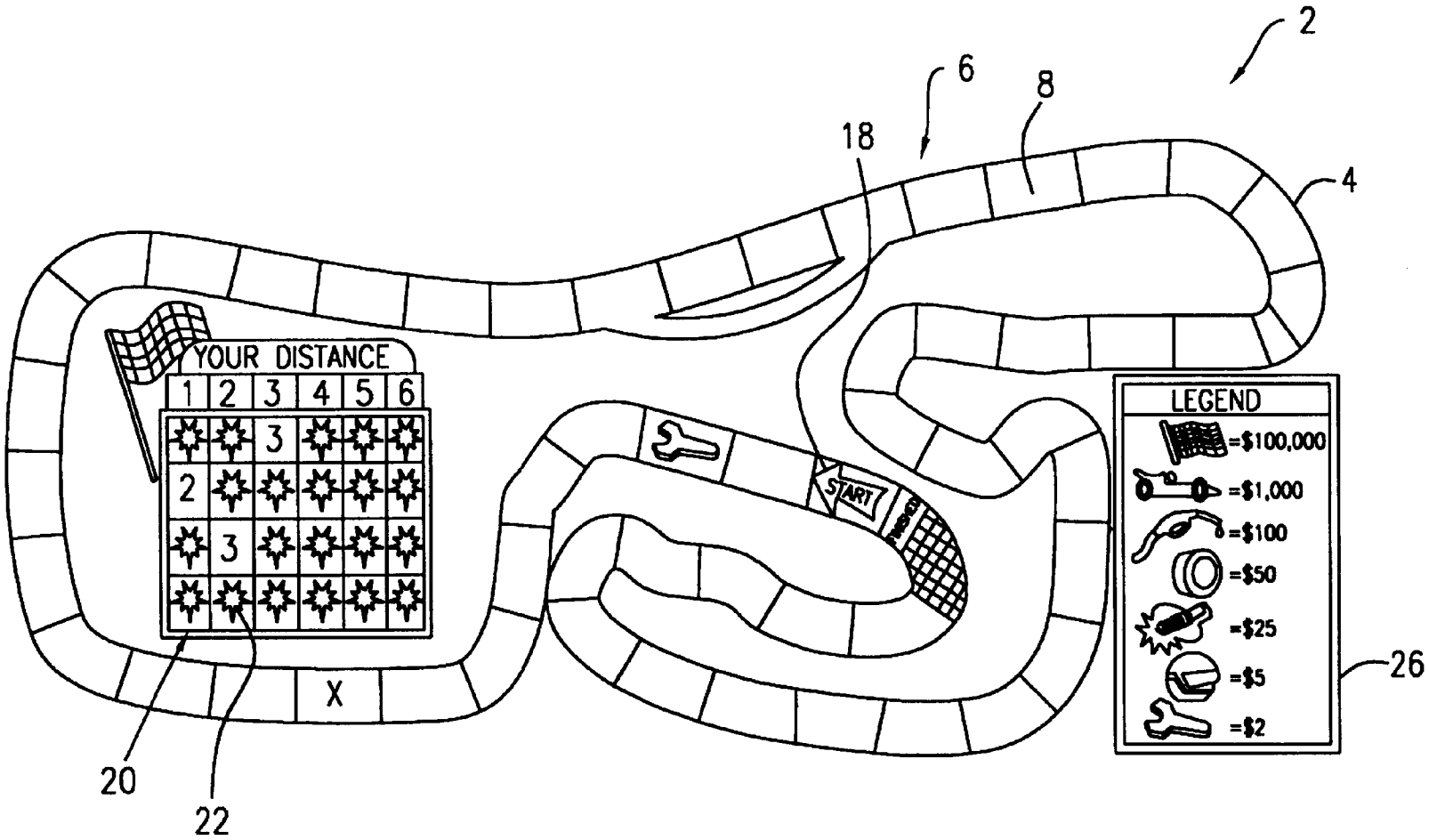
FIG. 4 is a top view of the lottery ticket of FIG. 3 showing the removal of a the scratch-off layer covering some of the directional symbols of the second play area and corresponding individual play regions of the first play area.

In a further embodiment of the invention, as depicted in FIGS. 3 and 4, the play action game may be played as a probability game. In this embodiment, there is provided a lottery ticket 2 having a top face 4 which includes a first play area 6 essentially the same as the play area 6 in the embodiment of FIGS. 1 and 2. The first play area 6 includes a plurality of individual play regions 8 which, as in the embodiments of FIGS. 1 and 2, may be in different formats. In the embodiment shown in FIGS. 3 and 4, the individual play regions 8 are aligned in the form of a race car track.

There is also provided a second play area 20 which contains a plurality of spaces 22 each containing a directional symbol 24 (see FIG. 4) which provides instructions to the player for moving from one individual play region 8 to another. The directional symbol 24 in each space 22 is covered by a scratch-off layer 25. In the probability game format, the player will select less than all of the spaces 22 and thereby play less than all of the directional symbols 24 available in the second play area 20.

The directional symbol 24 provides information on the specific individual play regions 8 that the player is to uncover. In this regard, each individual play region 8 will contain a prize supporting symbol, a prize defeating symbol, or optionally a neutral symbol. A neutral symbol is any symbol including a blank space which is neither a prize supporting symbol or a prize defeating symbol. In the embodiment shown specifically in FIG. 4, the neutral symbol is shown as a blank space.

As shown specifically in FIGS. 3 and 4, the second play area 20 includes six columns each containing four spaces 22. There are therefore a total therefore of twenty-four spaces 22 each containing a directional symbol 24. In accordance with this particular embodiment, the player selects a single space 22 from each of the six columns so that the total play action game contains six moves. In playing the game, the player selects a single space 20 from the first column. As shown specifically in FIG. 4 the exposed space reveals a number ("2") which is the number of individual play regions 8 that the player is to move from the starting line. This directional symbol directs the player to move to the second individual play region 8 from the starting line and reveal the symbol contained therein. As shown in FIG. 4, the second individual play region contains a prize as shown in the prize area 26.

The player then moves to the second column and as shown specifically in FIG. 4 uncovers one of the spaces 20 to reveal a directional symbol ("3"). The player then moves four individual play regions 8 from the previously uncovered individual play region to uncover the next individual play region which as shown is a blank space or a neutral symbol that doesn't affect the winning or losing of the ticket. Proceeding to the third column, the player again uncovers a single space to reveal a directional symbol ("3") and thereby moves three individual play regions 8 from the previous uncovered individual play region and uncover a prize defeating symbol in the form of "X". The prize defeating symbol may result in the lose of the game depending on the rules of the game to be played. Accordingly, the play action game can require the player to make all of the moves required by the individual columns in the second play area or may allow the player to play less than all of the columns, particularly if a desirable prize has been won so as to avoid uncovering a prize defeating symbol in a subsequent move.

Modifications of the present invention will be apparent to those of ordinary skill in the art and include the use of additional or different prize supporting symbols, prize defeating symbols and neutral symbols which may result in a prize, or during the value of a particular prize or may result in a losing ticket.

What is claimed is:

1. A lottery ticket comprising a first play area comprising a player-identification area containing a single player-identification symbol, a plurality of individual play regions each of which contains the player-identification symbol, a prize defeating symbol or a neutral symbol which is covered by a scratch-off layer, at least one second play area containing a prize symbol, each of said second play areas being associated with an individual play region by being adjacent thereto such that if a player-identification symbol appears in such associated individual play region, the player wins the prize appearing in the second play area.

2. The lottery ticket of claim 1 wherein the first play area comprises a continuous line of individual play regions.

3. The lottery ticket of claim 1 wherein the neutral symbol is in the form of a blank space.

4. The lottery ticket of claim 1 comprising a plurality of the second play areas.

5. The lottery ticket of claim 1 wherein the player-identification symbol in the player-identification area is covered by a scratch-off layer.

6. A lottery ticket comprising a first play area comprising a plurality of individual play regions each of which contains a prize supporting symbol, a prize defeating symbol or a neutral symbol which is covered by a scratch-off layer, a second play area containing a plurality of directional symbols, each of which directs the player as to which of the individual play regions should be uncovered, and a prize determining region for awarding a prize if the player accumulates at least the minimum number of prize supporting symbols before obtaining a preselected number of prize defeating symbols.

7. The lottery ticket of claim 6 wherein the first play area comprises a continuous line of individual play regions.

8. The lottery ticket of claim 6 wherein the neutral symbol is in the form of a blank space.

9. The lottery ticket of claim 6 wherein the second play area comprises a grid of individual spaces each of said spaces containing a directional symbol.

10. The lottery ticket of claim 6 wherein the grid contains a preselected number of spaces and the player uses the directional symbols in each space.

11. The lottery ticket of claim 6 wherein the grid contains a preselected number of spaces and the play uses less than all of the directional spaces.

12. The lottery ticket of claim 11 wherein the spaces are arranged in a plurality of rows and columns with each row and column comprising a plurality of spaces each containing a directional symbol.

* * * * *